US008453352B2

(12) United States Patent
Dodge

(10) Patent No.: US 8,453,352 B2
(45) Date of Patent: Jun. 4, 2013

(54) SUPPORTIVE SPORT BOOT MADE OF RIGID MATERIALS

(75) Inventor: David J. Dodge, Williston, VT (US)

(73) Assignee: Perfect Storm Sports Technology, LLC, Williston, VT (US)

( * ) Notice: Subject to any disclaimer, the term of this patent is extended or adjusted under 35 U.S.C. 154(b) by 754 days.

(21) Appl. No.: 12/562,199

(22) Filed: Sep. 18, 2009

(65) Prior Publication Data

US 2010/0180471 A1 Jul. 22, 2010

Related U.S. Application Data

(60) Provisional application No. 61/145,146, filed on Jan. 16, 2009.

(51) Int. Cl.
*A43B 5/04* (2006.01)
*A43B 19/00* (2006.01)

(52) U.S. Cl.
USPC ..... 36/117.1; 36/117.3; 36/117.8; 36/118.2; 36/118.7; 36/10

(58) Field of Classification Search
USPC ..... 36/117.1–117.9, 118.1–118.9, 119.1, 36/10, 55
See application file for complete search history.

(56) References Cited

U.S. PATENT DOCUMENTS 3,718,994 A 3/1973 Spier
3,775,872 A * 12/1973 Rathmell ..... 36/117.2
4,154,009 A * 5/1979 Kubelka et al. ..... 36/117.6
4,268,931 A * 5/1981 Salomon ..... 12/146 R
4,428,130 A * 1/1984 Perotto ..... 36/117.6
4,720,926 A * 1/1988 Marxer ..... 36/117.6
4,813,668 A 3/1989 Solloway (Continued)

FOREIGN PATENT DOCUMENTS

EP 1295540 A1 3/2003
EP 1527706 A1 5/2005

(Continued)

OTHER PUBLICATIONS

Related PCT Application No. US09/69011 filed Dec. 21, 2009, entitled Supportive Sport Boot Made of Rigid Materials; David J. Dodge.

(Continued)

*Primary Examiner* — Jila M Mohandesi
*Assistant Examiner* — Sharon M Prange
(74) *Attorney, Agent, or Firm* — Downs Rachlin Martin PLLC

(57) ABSTRACT

A sport boot, such as a snow ski boot, that includes a shell having a rigid foot portion. The foot portion includes a heel pocket and an instep region that is largely immovable relative to the heel pocket due to the rigidity of the foot portion. The boot also includes a highback support region that snugly engages the leg of a user during use. A heel-track is located on the dorsal side of the boot between the highback support region and the heel pocket. The heel-track provides a concave space that receives the user's heel when the user is putting-on and taking-off the boot to counter the relative immovability of the instep region of the boot against the engaging action of the user's foot. The sport boot can also include a special boot liner having an expandable dorsal region, and, optionally, other features that compliment the heel-track of the shell.

28 Claims, 12 Drawing Sheets

U.S. PATENT DOCUMENTS

| | | | | |
|---|---|---|---|---|
| 5,068,985 | A * | 12/1991 | Pozzebon | 36/117.6 |
| 5,595,006 | A | 1/1997 | Perrissoud et al. | |
| 5,678,331 | A * | 10/1997 | Bonaventure | 36/117.1 |
| 6,026,596 | A * | 2/2000 | Seidel | 36/117.4 |
| 6,253,467 | B1 * | 7/2001 | Maravetz et al. | 36/115 |
| 6,622,402 | B2 * | 9/2003 | Challande | 36/118.7 |
| 2002/0088146 | A1 | 7/2002 | Joseph et al. | |
| 2003/0097766 | A1 | 5/2003 | Morgan | |
| 2004/0148807 | A1 | 8/2004 | Grandin | |
| 2006/0064904 | A1 | 3/2006 | Confortin et al. | |

FOREIGN PATENT DOCUMENTS

| | | | |
|---|---|---|---|
| WO | 96/24266 | | 8/1996 |
| WO | 97/26947 | | 7/1997 |
| WO | 0051458 | A1 | 9/2000 |
| WO | 2009097550 | A1 | 8/2009 |

OTHER PUBLICATIONS

Martin Olson, Ski Canad, Fall 2003, Boot Opening. As boot manufacturers fine-tune the balance between comfort and performance, features like anti-skid soles and ski-binding integration give even more reason to consider new boots this year, Gear Guide '04, pp. 82-89.

International Search Report and Written Opinion dated Aug. 6, 2010 for related application PCT/US2009/069011 filed Dec. 21, 2009 entitled "Supportive Sport Boot Made of Rigid Materials," DODGE.

* cited by examiner

SUPPORTIVE SPORT BOOT MADE OF RIGID MATERIALS

RELATED APPLICATION DATA

This application claims the benefit of priority of U.S. Provisional Patent Application Ser. No. 61/145,146, filed on Jan. 16, 2009, and titled "Ski Boot Made From Composite Materials," which is incorporated by reference herein in its entirety.

FIELD OF THE INVENTION

The present invention generally relates to the field of sport equipment. In particular, the present invention is directed to a supportive sport boot made of rigid materials.

BACKGROUND

Various sports, such as alpine, alpine/touring and telemark skiing, require boots that support the foot, ankle and, to varying degrees, the lower leg. All three of the above disciplines have these basic requirements. There are differences in the functional details and degree of support, but all three require that the foot, ankle and lower leg be supported in such a way that the range of motion is controlled within a specific range and that there is a specific resistance within the allowed range of motion that provides feedback to the skier and allows forces to be transmitted from the skier to the ski that would otherwise be impossible or difficult to apply.

As the need for more support developed, ski boot designs became stiffer and stiffer. Early ski boots were made from leather, then plastic coated leather, then designs eventually settled on the use of thermoplastic injection molded elastomers, such as thermoplastic polyurethane (TPU), polyamides, and blends such as Pebax®. Injection molded thermoplastics have been in use almost exclusively since the early 1970s.

There were some attempts to use fiberglass in the 1970s, notably the Raichle "Red Hot" ski boot. This boot would have been impossible to put on or take off due to the extremely rigid materials used. Raichle overcame the rigid nature of the materials by using a hinge along the sole that allowed the boot to split open from the top, toe to heel, and a leather upper that allowed forward flexing of the skier's ankle. Since the lower could not flex at all and maintained a fixed volume regardless of how it was closed, Raichle also had to provide for a way to fit the volume of the lower to various foot volumes and shapes. The following three problems, i.e., fixed volume lower, unnatural method of entry/exit and difficulty of mating a leather upper for forward flex to the rigid lower, prevented this boot design from achieving lasting success.

Recently, Lange/Rossignol attempted to use stiff composites to build competition ski boots for their sponsored World Cup skiers (see European Patent Publication No. EP1295540 B1, titled "Skiboot"). Lange/Rossingnol made several experimental ski boots using different combinations of composite materials. However, it appears those efforts have not yet resulted in any commercial ski boots incorporating the experimental concepts. The current inventor believes that one challenge the Lange/Rossignol designers may not have overcome is devising an entry/exit strategy that accommodates the extreme stiffness of the experimental boots due to the composites.

The only commercial use of composite materials in ski boot construction has been as inserts that are over-molded during the traditional injection molding of thermoplastics.

For example, a small, shaped plate of composite material is prepared and then placed in a modified ski boot mold. Thermoplastic polyurethane, or other similar thermoplastic, is then injection molded around and partially over the insert to make it an integral part of the boot. This method uses the stiffness, strength and light weight of the composite material in areas of the boot where it can do the most good. However, it is not very economical as it requires very expensive molds, very expensive materials and very expensive preparation of the insert. Also, the weight and stiffness advantages of the composite materials are nearly erased by the heavy, rubbery thermoplastics that largely fail to efficiently transmit the forces they were designed to carry. Consequently these inserts are regarded primarily as cosmetic.

SUMMARY

In one implementation, the present disclosure is directed to a sport boot. The sport boot includes a shell that includes: a leg portion that has a shin region and a highback leg support region that acts to firmly support a portion of a leg of a person when the person is using the sport boot; a foot portion for receiving a foot of the person when the person is using the sport boot, the foot portion having an instep region and an instep transition region providing a directional transition between the instep region and the shin region of the leg portion, the foot portion including a toe end, a heel end and a sole portion, the sole portion extending from the toe end to the heel end, the foot portion having a lateral portion and a medial portion and being substantially rigid in a direction parallel to a longitudinal vertical plane that bisects the foot portion into the lateral portion and the medial portion; a heel pocket for inhibiting movement of a heel of the person in a direction away from the sole portion when the person is using the sport boot; and a heel track extending between the highback support region and the heel pocket and forming a concave space interior to the shell, the heel track receiving the heel of the person to accommodate the substantial rigidity of the foot portion in the direction parallel to the longitudinal vertical plane when the person is inserting the foot into the sport boot.

In another implementation, the present disclosure is directed to a boot liner for a sport boot. The boot liner includes a body made of a compressible material and having a shape that snugly fits a human foot and lower leg and that fits a boot shell that includes: a throat region having a dorsal heel track for aiding a user in inserting the human foot and lower leg into the boot shell when the boot liner is present in the boot shell; and a heel pocket for receiving the heel of the human foot when the human foot is fully inserted into the boot shell; the body including a leg portion containing an expandable dorsal region in registration with the heel track when the boot liner is present in the boot shell, the expandable dorsal region configured to temporarily expand the leg portion to an expanded configuration from an un-expanded configuration to allow the heel of the human foot to readily enter the heel track when the person is inserting the human foot into the boot shell and configured to contract from the expanded configuration when the heel is seated in the heel pocket.

In still another implementation, the present disclosure is directed to a sport boot system. The sport boot system includes a shell that includes: a leg portion that has a shin region and a highback leg support region that acts to firmly support a portion of a leg of a person when the person is using the sport boot system; a foot portion for receiving a foot of the person when the person is using the sport boot system, the foot portion having an instep region and an instep transition region providing a directional transition between the instep region and the shin region of the leg portion, the foot portion including a toe end, a heel end and a sole portion, the sole portion extending from the toe end to the heel end, the foot portion having a lateral portion and a medial portion and being substantially rigid in a direction parallel to a longitudinal vertical plane that bisects the foot portion into the lateral portion and the medial portion; a heel pocket for inhibiting movement of a heel of the person in a direction away from the sole portion when the person is using the sport boot system; and a heel track extending between the highback support region and the heel pocket and forming a concave space interior to the shell, the heel track receiving the heel of the person to accommodate the substantial rigidity of the foot portion in the direction parallel to the longitudinal vertical plane when the person is inserting the foot into the sport boot system; and a liner made of a compressible material and having a shape that snugly fits the foot and the lower leg and that fits into the shell, the liner including a leg portion containing an expandable dorsal region in registration with the heel track when the liner is present in the shell, the expandable dorsal region configured to expand the leg portion to an expanded configuration to allow the heel of the foot to readily enter the heel track when the person is inserting the foot into the sport boot system and configured to contract from the expanded configuration when the heel is seated in the heel pocket.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

General Configuration

Figure 1:
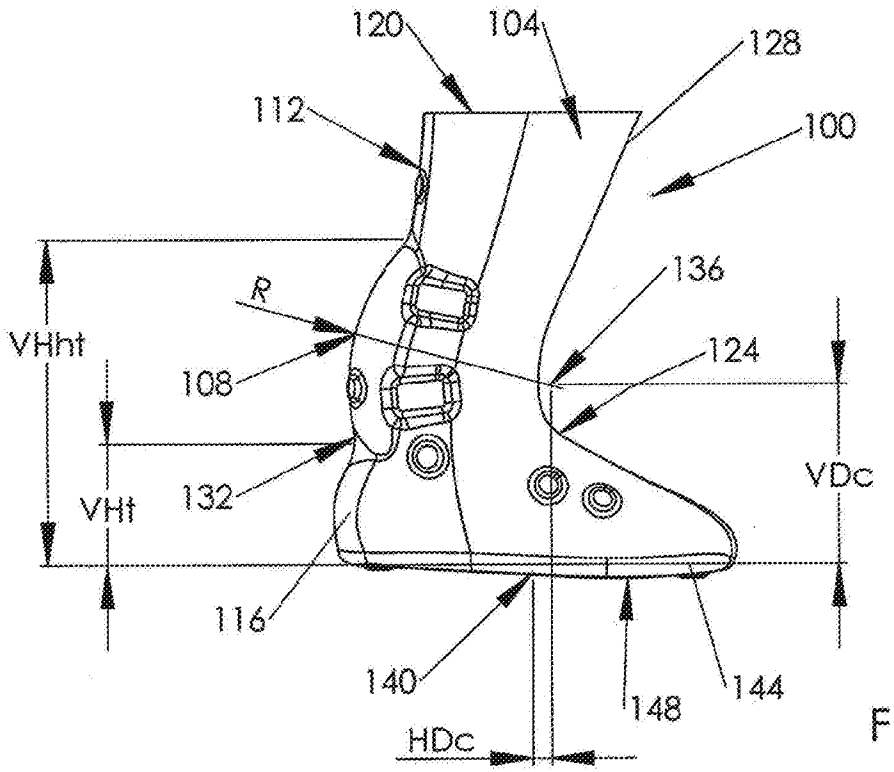
FIG. 1 is a diagrammatic side elevational view of a sport-boot configuration incorporating broad concepts of the present invention.

Referring now to the drawings, FIG. 1 illustrates a sport-boot configuration 100 incorporating novel concepts of the present disclosure. As those skilled in the art will readily appreciate, sport-boot configuration 100 can be adapted for use in virtually any sport requiring highly controlled and/or highly constrained movement of a wearer's foot (not shown) relative to the wearer's corresponding leg. Examples of such sports include alpine skiing, alpine/touring skiing, telemark skiing, snowboarding and ice skating. Sport-boot configuration 100 is especially suited for constructing a sport boot that has a highly rigid shell 104, but is relatively very light in weight when compared to a corresponding conventional ski boot. Such light weight can be achieved, for example, by constructing at least a portion of shell 104 from a composite material (a.k.a., "composite"), examples of which include a fiber-reinforced monolayer and a fiber-reinforced laminate, among others. As will be readily understood, especially from reviewing the exemplary ski boot 200 of FIG. 2, shell 104 need not be a unitary structure, but rather may comprise multiple parts, such as an upper part movably attached to a lower part. In addition, sport-boot configuration 100 may further include one or more other components, such as an outsole, a liner (separate or integral), one or more buckles and/or other fastening/closure/tightening devices and a cuff collar (not shown), among others, and any combination thereof.

Important features of sport-boot configuration 100 are a heel-track 108, a highback support region 112 and a distinct heel pocket 116. (It is noted that for the sake of the following explanation that shell 104 has a substantially uniform thickness (e.g., +/−1 mm) throughout, such that the external curves shown in FIG. 1 are also present on the interior of the shell, with the difference being that the interior curves are spaced from the exterior curves by that substantially uniform thickness. In this example, the shell can be assumed to be as thin as the line thickness used to depict the relevant portion of shell 104.) Heel-track 108 provides a concave space (viewed from inside the throat 120 of shell 104) that receives the wearer's heel during insertion and removal of the foot into and out of the shell. Heel track 108 allows the instep region 124 of shell 104 to be highly rigid and does not require the instep region to be subjected to large deformations, reconfigured and/or moved out of the way for the wearer to insert and remove the foot, as must be done, for example, with conventional front- and mid-entry ski boots. With heel track 108, shell 104 also does not require any other type of entry means, such as a rear entry means.

Highback support region 112 provides a support region at the rear of sport-boot configuration 100 that cooperates with a shin support region 128 to provide the necessary firm engagement of shell 104 with the leg of the wearer. In the context of alpine, touring and telemark ski boots, highback support region 112 and shin support region 128 form a cuff that generally mimics the cuff portion of a conventional sport boot. Heel pocket 116 provides a distinctive region at the rear of shell 104 that receives the heel (not shown) of the wearer when the wearer's foot is fully inserted into the shell. Heel pocket 116 firmly holds the wearer's heel, inhibiting it from moving sideways and upward during use of the shell 104 for its intended purpose. Heel-track 108 and heel pocket 116 are separated from one another, at least in functionality, by a transition 132 that essentially defines the lower end of the heel track and the upper end of the heel pocket. Without transition 132, it should be understood that heel pocket 116 would have significantly diminished vertical heel-holding ability.

FIG. 1 illustrates an exemplary geometry for heel track 108 and heel pocket 116. In this example, heel track 108 has a curvature of constant radius R, with the center of curvature 136 located forward of the mid-length 140 of the sole 144 of shell 104 and above instep region 124. In one very specific example, the horizontal distance HDc from mid-length 140 to center of curvature 136 is 42 mm, the vertical distance VDc from the inside bottom of shell 104 at the ball-of-the-foot region 148 to the center of curvature 136 is 110 mm, the vertical height VHt of transition 132 above the inside bottom of the shell at the heel region is 80 mm, the vertical height VHht of heel track 108 above the inside bottom of the shell at the heel region is 230 mm and radius R is 169 mm. As those skilled in the art will readily appreciate, these values are for a single size of shell 104 with a particular set of configuration variables, such as forward-lean angle, foot size, liner thickness, diameter of cuff region, etc. Of course, these values can vary for differing sets of configuration variables.

Ski Boot Example

As those skilled in the art know, composites are orders of magnitude stiffer and stronger than thermoplastics. These physical properties present to the ski boot industry both performance opportunities and design challenges that have so far been insurmountable. At first impression, to those knowledgeable in the art, composites would not seem to be a good choice for a product that needs to be flexible. However, since composites are both stronger and stiffer, the excess strength allows a designer to reduce the thickness of the material proportionately. By happenstance, the ratio of strength to stiffness of some composites is such that reducing the material thickness to maintain comparable strength also results in the flexural stiffness changing in a way that maintains the same flexural stiffness and feel as conventional ski boot materials. For example, when a composite-laminate ski boot is designed properly, it can have the same strength and feel as a 5 mm thick conventional ski boot material using only a 1 mm thick composite material, with the added benefits of a 75% reduction in weight and hundreds of times increase in stiffness in the in-plane direction that affects performance, with little or no effect on the flexural feel of the boot.

In-plane stiffness is the stiffness in tension and compression verses the flexural stiffness or resistance to bending. Deflection of the ski boot sidewalls in the tension/compression (in-plane) direction results in lateral instabilities in the ski boot. These deflections require the skier to make edge angle adjustment continually as loads increase and decrease. They also lead to edge "chatter." As the boot sidewalls deflect in response to edging loads, the ski edge angle is reduced to the point where the ski disengages with the snow. The sudden release of the loads causes the boot to relax and returns the ski to the original edge angle, which causes the loads to build up again, deflecting the boot sidewalls, etc., etc. The frequency and amplitude of this cyclical "chatter" is dictated by the mass of the ski boot and the in-plane stiffness of the boot sidewalls. By reducing the mass and increasing the stiffness one can increase the frequency and more importantly reduce the amplitude of the "chatter." If one reduces the mass and increases the stiffness sufficiently, the amplitude will always be less than the ski edge engagement with the snow and there will be no "chatter" at all. The bottom line is that a properly designed composite boot can be 50% to 75% lighter, hundreds of times stiffer in tension and compression, with the same flexural feel as a conventional thermoplastic polyurethane (TPU) ski boot. These properties can provide the following advantages:

1. Lower mass=quicker movements;
2. Lower mass=higher frequency of vibration=lower amplitude=less edge chatter=better snow contact;
3. Lower mass=less fatigue;
4. Higher in-plane stiffness=higher frequency of vibration=lower amplitude=less edge chatter=better snow contact;
5. Higher in-plane stiffness=less deflection under load=better control=more consistent response;
6. Higher frequency vibration=lower amplitude=vibration absorbed by boot liner, skin and muscle instead of bones and joints=less fatigue=less injury; and
7. Thinner wall thickness=narrower outside boot dimensions=less boot interference with the snow=more angulation is possible=no "boot out".

A composite ski boot design must solve three primary problems to be successful. A first problem is presented by the high in-plane stiffness of a boot shell made of a composite material. In areas of the boot where there is significant compound curvature, the in-plane stiffness contributes to flexural stiffness and makes these areas very resistant to any deflection. Fortunately, this has little or no negative effect on performance, fit or feel. It does, however, make getting the boot on and off your foot very difficult. This is due to the fact that one of the areas of the boot with the most severe compound curvature is the instep area of the foot, precisely the area that must deflect the most to open the boot enough to get your foot to pass through the throat of the boot. This is also a problem with all conventional thermoplastic front entry boots, but it is not nearly as severe as it would be with a highly rigid composite boot.

The ski industry has tried to address this problem for decades with various designs. In the 1970s and 1980s rear entry boots solved this problem with a mechanical solution that allowed the back of the boot to pivot open, thus widening the throat sufficiently to allow easy entry. In the 1980s the poor performance of the rear entry boot was recognized and Lange developed a mid-entry boot with a more conventional, high performance, shell and an upper that could tilt back enough to gain easy entry. It was sufficiently successful that it displaced the rear entry boot from the market. However, the extra mechanical parts had a negative impact on performance, and the market, unwilling to compromise on performance, eventually returned to a front entry design and accepted the entry problem as a necessary compromise.

A second problem is presented by the processing limitation of composite materials. Composite materials are available as consolidated sheets of fibers and matrix resin that can be cured and/or formed with pressure and/or heat, as fabrics that are cut and placed dry then impregnated with matrix resin under pressure and/or heat, or as fabrics that are pre-impregnated then cut, placed and cured or thermoformed with pressure and/or heat. This means that it is very difficult to form a complete ski boot shell in one piece. The present invention seeks to disclose preferred methods of construction to divide, form and join various pieces that can be assembled into the major components of a ski boot or a complete ski boot.

A third problem is the detailed features of the boot sole required to conform to standards that assure boot to ski binding compatibility, such as International Organization for Standardization (ISO) standards ISO5355 and ISO9523. The processing limitations and other properties of composites make forming such details extremely difficult. To avoid these difficulties, a thermoplastic injection molded sole must be joined to the composite lower shell. The present invention seeks to disclose preferred methods and constructions to achieve this joining.

A successful composite boot must solve the three problems just described without resorting to complicated performance-sapping mechanical solutions. This disclosure presents a number of unique broad concepts for solving those problems without resorting to those undesirable solutions. The unique concepts disclosed herein include:

1. A non-conventional throat geometry (the area just above the heel) that increases the volume of the throat area without compromising support or performance.
2. A construction that divides the lower shell into two halves along the longitudinal (toe/heel) plane and joins the two parts with a flange joint. The composite laminates are designed so that the ratio of tensile stiffness to flexural stiffness is maximized.
3. A construction that completes the lower by joining a separately molded sole to the lower shell in cooperation with the flange used to join the two lower shell parts.
4. A construction that divides the upper into two halves along the longitudinal (toe/heel) plane and joins the two parts with a lap joint that then cooperates with the flange joint that joins the two lower shell parts. The materials used in the upper laminates are typically less stiff than the laminates used in the lower.
5. A ski boot liner construction that cooperates with the non-conventional "high volume throat" heel geometry allowing easy entry and exit of the foot from the boot.

FIGS. 2-7 illustrate one example of a ski boot 200 incorporating these and other broad concepts. It is noted that ski boot 200 is shown without a liner. However, as described below, exemplary ski boot 200 is designed to be used with a liner, such as boot liner 800 of FIGS. 8-10. Consequently, as the following description of ski boot 200 is being read, the reader should keep in mind that the ski boot will contain a liner that provides much of the functionality of a conventional ski-boot liner.

Figure 2:
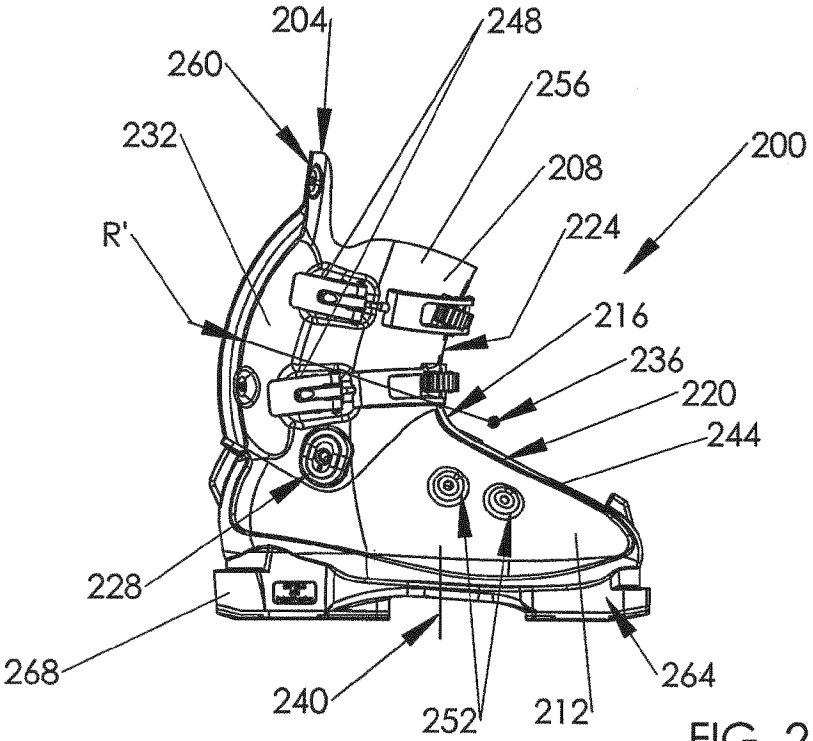
FIG. 2 is a side elevational view of a ski boot made in accordance with broad concepts of the present disclosure.
Figure 3:
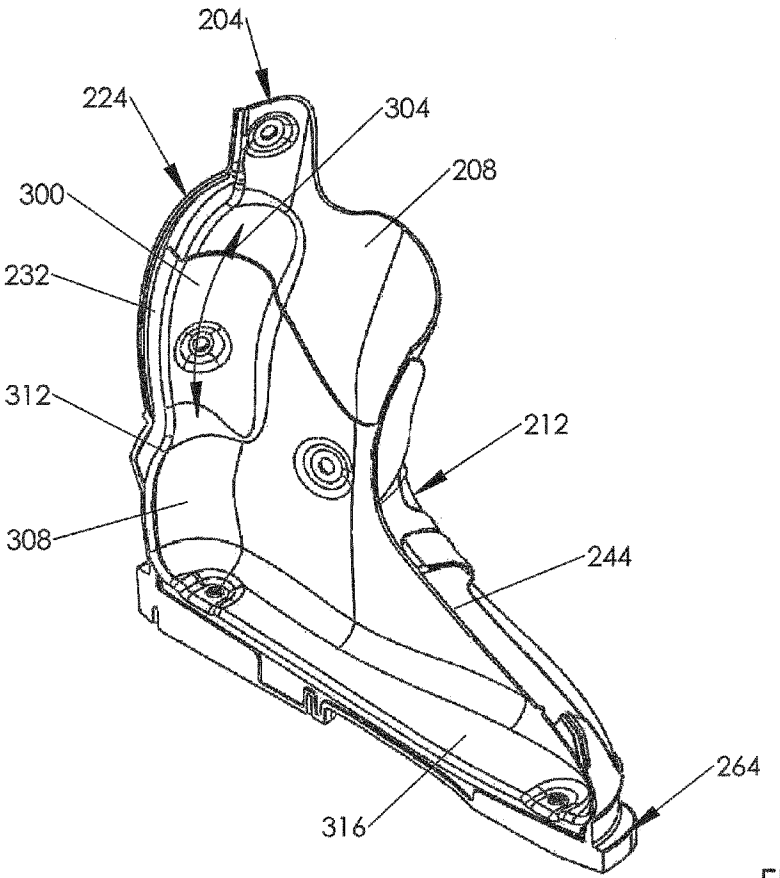
FIG. 3 is a vertical-cutaway perspective view of the ski boot of FIG. 2.

Referring now to FIGS. 2 and 3, ski boot 200 includes a two-part shell 204 having an upper shell 208, a lower shell 212 and an "instep transition" 216 between the instep region 220 and leg region 224 of the boot. As will be described below in more detail, upper shell 208 is pivotably attached to lower shell 212 by a pair of rotatable fasteners 228. Shell 204 includes a high volume throat geometry forming a heel track 232. As in sport-boot configuration of FIG. 1, this geometry includes an interior concaved shape 300 (FIG. 3) that is defined as an area approximating the cross section of the heel of the foot that is swept along a path 304 that begins/ends just above a heel pocket 308 formed in lower part 212 of shell 204. In this example, the center of curvature 236 (FIG. 2) of path 304 (FIG. 3) is located just above the instep area region 220 (FIG. 2) of lower part 212 and just forward of the mid-length 240 of the lower part. This shape approximates an area that is swept out by the heel of a wearer's foot (not shown) as it enters boot 200 when instep transition 216, which in the example is formed by a pair of overlapping flaps 244 (upper portions of both flaps are more clearly seen in FIG. 6A), is restricted such that it provides no more flex than would be necessary to accommodate various foot shapes. In other words, flaps 244 need to flex only enough for fitting needs and do not need to be made excessively flexible for entry/exit needs, as in conventional front- and mid-entry ski boots.

In this connection and referring still to FIG. 2, boot 200 includes one or more buckles and/or other securement devices and a cuff collar for making the final securement of the boot to a wearer's leg. Such devices may be of any suitable type, such as any one of the types available on convention ski boots. It is noted that FIG. 2 illustrates only latch portions 248 of two securement devices on upper shell 208. However, in this example, lower shell 212 would also include one or two securement devices, but these devices are not shown for convenience. That said, FIG. 2 does show a pair of attachment points 252 where such securement devices would be attached to lower shell 212. Depending on the type of material(s) lower shell 212 is/are made of, attachment points may be integrally formed with the lower shell or, alternatively, formed separately from the lower shell and attached thereto using any suitable fastening means, such as bonding (e.g., adhesive, chemical), mechanical fastening, welding, brazing, etc, and any combination thereof.

The high-volume throat shape that interior concave shape 300 (FIG. 3) adds to ski boot 200 does not infringe into heel pocket 308 of the boot. The shape of heel pocket 308 is very important to keep the heel of the wearer from lifting during skiing maneuvers. During entry, as the heel of the wearer's foot follows path 304 of heel track 232, it is pushed slightly forward of its final resting position as it descends down the heel track. The wearer's heel then drops down, and it is pushed slightly back into the heel pocket by resistance from instep flaps 244. The closing of one or more securement devices (here, two devices) force flaps 244 together, tightening lower shell 212 and further driving the wearer's heel backward and securing it in heel pocket 308. The shape of heel pocket 308 and the presence of a transition 312 between the heel pocket and interior concave shape 300 of heel track 232 inhibits the wearer's heel from moving in any direction during use. Similarly, the closing of the securement device(s) (here, two devices) on upper shell 208 cause ski boot 200, and particularly a cuff region 256 above heel track 232, to firmly engage the leg of the wearer. None, some or all of the securement devices provided may be adjustable in the amount of securement force they provide, depending on the particular design of ski boot 200.

Removal of the foot first requires opening the securement device(s), forcing the foot slightly forward and then lifting the heel straight upwards until it falls into interior concave shape 300 of heel track 232. This requires flaps 244 of lower shell 212 to open only enough to allow the foot, in this example, to move forward about 8 mm and upward about 30 mm. After that, the wearer's heel falls into heel track 232 and flaps 244 are not required to open significantly further. In contrast, in a conventional ski boot, a wearer's heel must be able to move at least 30 mm forward and 100 mm upward to remove the foot and the instep flaps of such a conventional boot must be able to accommodate this relatively large movement with acceptably low resistance.

The radius of curvature R' and the location of center of curvature 236 are designed such that heel track 232 does not infringe upon a highback support region 260 at the top, back, of upper shell 208. Highback support region 260 provides backward support for the skier. Forces applied to the back of the leg by highback support region 260 can be very high, and if the surface area of this region is insufficient and/or the pressure is not evenly distributed, it can be very uncomfortable for the skier. Consequently, the design of ski boot 200 provides highback support region 260 with sufficient area and a proper shape to transmit the necessary forces of skiing efficiently and comfortably.

In this example, lower shell 212 should be very stiff for performance reasons and only flexible enough to accommodate proper fit to various foot shapes and volumes, for example, a high instep/high volume foot vs. and a flat/low volume foot. Relatedly, ankle flex in this example is provided primarily by upper shell 208. Lower shell 212 is the foundation, or chassis, of ski boot 200 and should be designed with a minimum of compromises in stiffness. However, in conventional boots the maximum stiffness is limited to that which will still allow reasonable ease of entry/exit, thus compromising performance. The unique shape described above eliminates this constraint on maximizing performance and makes possible the use of composite materials.

In one embodiment, the material used to make lower shell 212 is a light-weight, high-performance composite. Examples of composite materials for lower shell 212 include materials comprising high-strength reinforcement encased in a polymer matrix. Examples of suitable high-strength reinforcement include carbon fibers, carbon fabric, glass fiber, glass fabric, Kevlar fibers and Kevlar fabric, among others (KEVLAR is a registered trademark of E.I. du Pont de Nemours and Company, Wilmington, Del.). Examples of suitable polymers for the matrix include, but are not limited to, thermoset epoxy resins, thermoplastic nylon resins, TPU resins and polypropylene resins. Such materials may be used as a single layer composite, or may be laminated with one or more other like or differing layers to form a composite laminate. Composite laminates can be designed so that the ratio of tensile stiffness to flexural stiffness is maximized. For example, a 4-ply glass/carbon/carbon/glass laminate (carbon core/glass skin laminate) will have a higher ratio of tensile stiffness to flexural stiffness than a glass core/carbon skin laminate.

In this embodiment, the material used to make upper shell 208 is also a high-performance composite, but can be less stiff than the material used for lower shell 212. Examples of a suitable composite for upper shell 208 include, but are not limited to, a TEGRIS® or PURE® polypropylene/polypropylene composite and a TEPEX® polyester/TPU composite.

Figure 5:
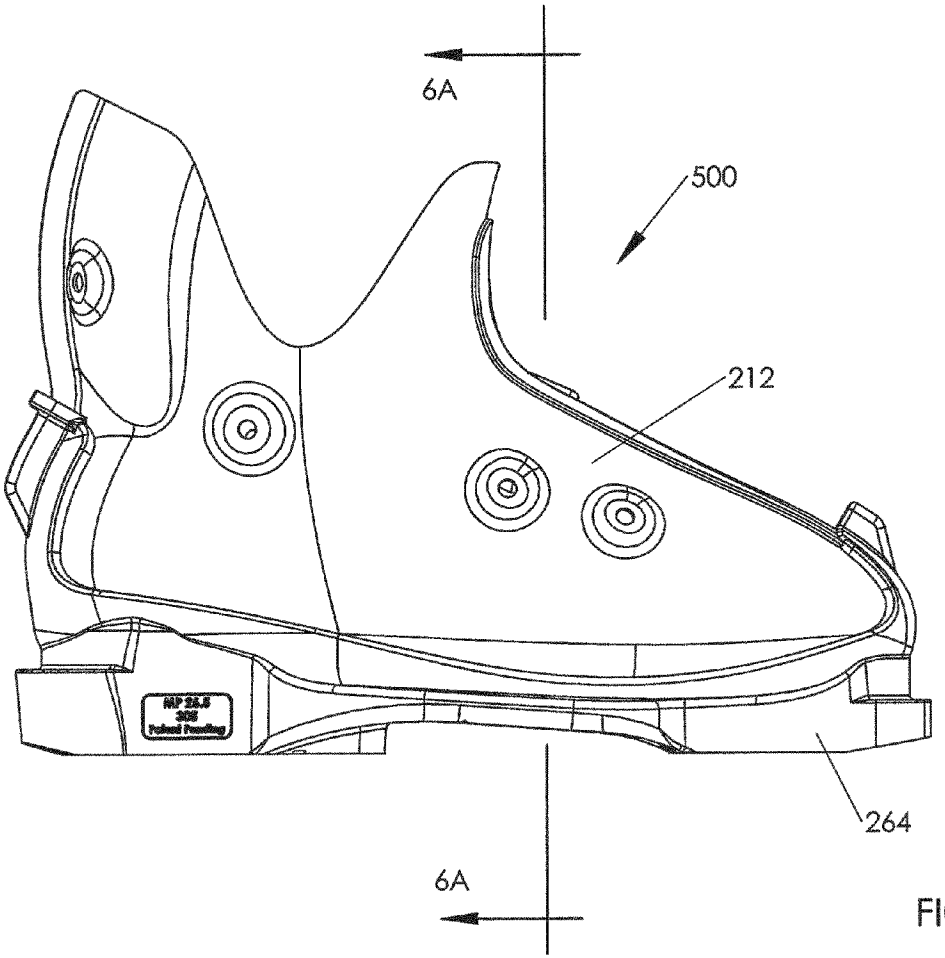
FIG. 5 is a side elevational view of the assembly of the lower shell of FIGS. 2, 3 and 4A-B with the sole of FIG. 2.

As seen in FIGS. 2, 3 and 5, ski boot 200 includes an outsole 264, which in this example, provides the conventional heel and toe lugs 268 for engaging a conventional ski binding (not shown). In some embodiments, outsole 264 is formed separately from lower shell 212 and secured thereto by any suitable means, such as overmolding, bonding (e.g., adhesive, chemical), mechanical fastening, welding, brazing, etc, and any sensical combination thereof. As a couple of non-limiting examples, outsole 264 can be made from TPU and overmolded to lower shell 212 or, alternatively, can be made of a urethane and reaction injection molded to the lower shell, among others. In other embodiments, outsole 264 could be formed integrally with lower shell 212.

Figure 4A:
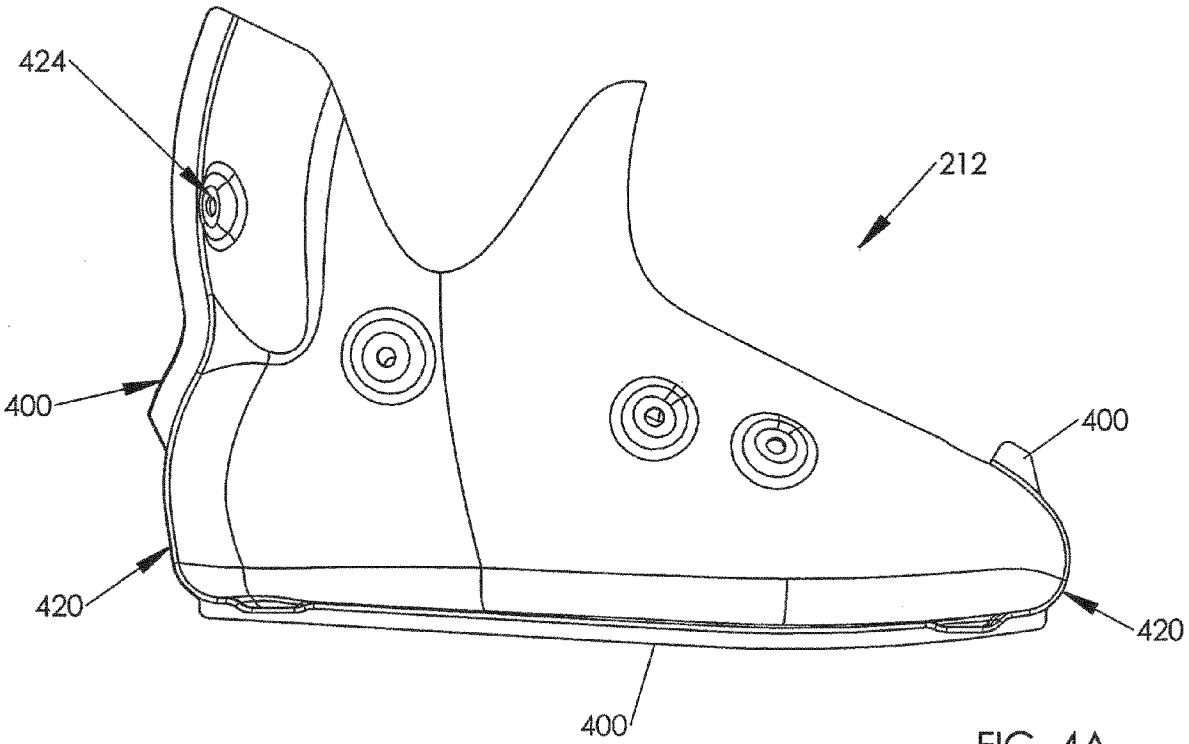
FIG. 4A is side elevational view of the lower shell of the ski boot of FIG. 2.
Figure 4B:
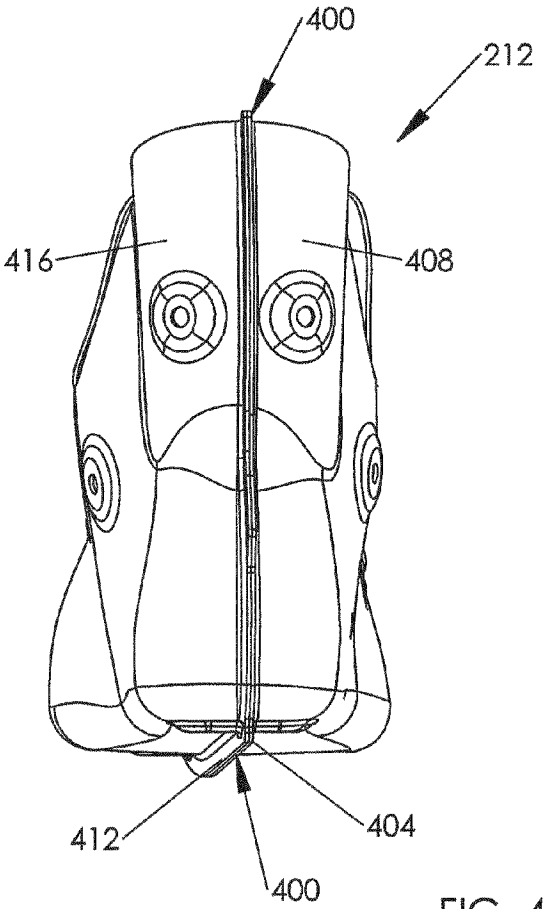
FIG. 4B is a rear elevational view of the lower of the ski boot of FIG. 2.

Referring to FIGS. 4A-B, the challenge of making lower shell 212 from a composite material has led the present inventor to develop a unique construction that divides the lower shell into two parts along a longitudinal (toe/heel) plane and joins the two parts with a flange joint 400. Flange joint 400 comprises a first flange 404 (FIG. 4B) on the medial part 408 of lower shell 212 that is fixedly secured to a matching second flange 412 on the lateral part 416 of the lower shell. First flange 404 on medial part 408 can be secured to second flange 412 on lateral part 416 using any suitable means, such as bonding using adhesives, ultrasonic welding, hot plate welding, radio frequency welding, and/or other welding and/or bonding technique. In one example, a portion 420 of flange joint 400 is removed at the heel and toe regions to allow the mating outsole 264 (FIG. 2) to be as short as possible. The separate medial and lateral parts 408, 416 are simple in shape and can be easily molded or formed using, for example, known simple, inexpensive tools and techniques. Another benefit of such a flange construction is that all surfaces to be bonded are easily accessible to fixtures and bonding equipment and all trimmed edges are hidden in the final assembly.

Figure 6A:
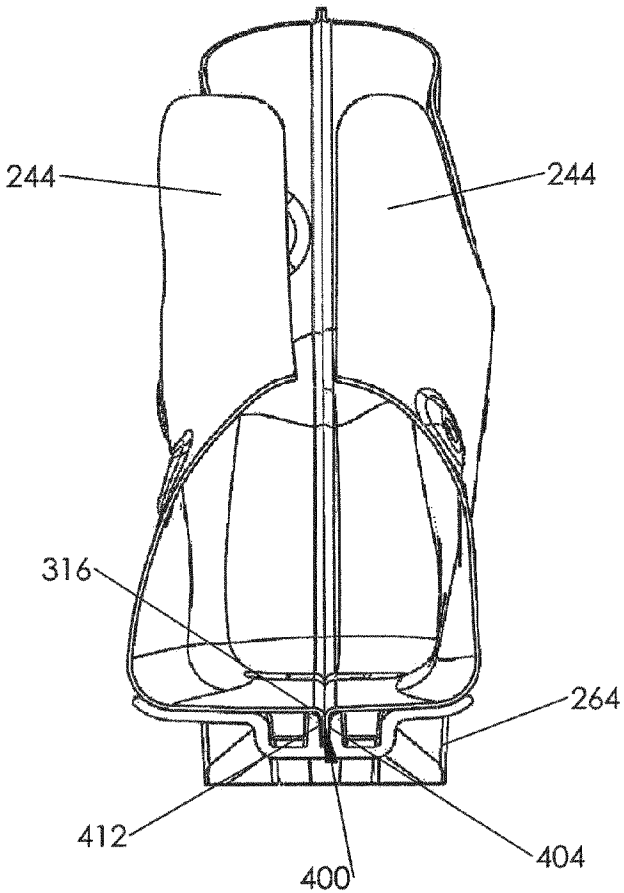
FIG. 6A is an enlarged cross-sectional view as taken along line 6A-6A of FIG. 5.
Figure 6B:
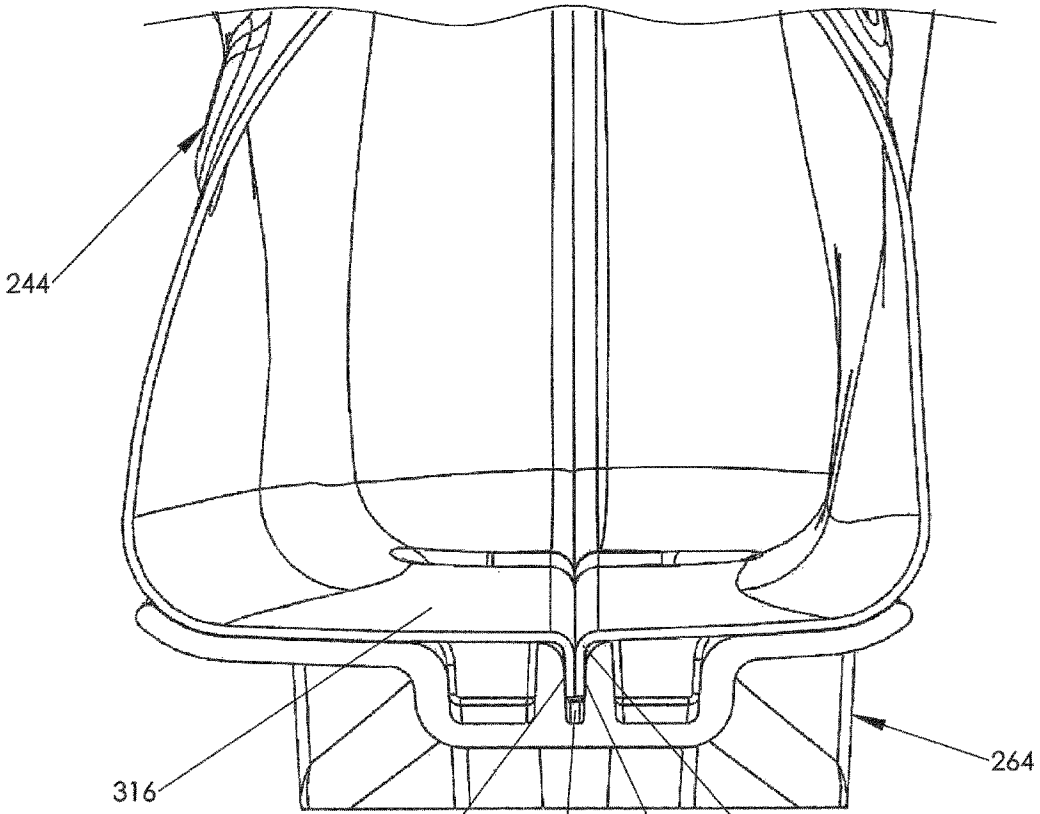
FIG. 6B is a further enlarged view of the cross-sectional view of FIG. 6A.

A further benefit of a flange construction is that the entire lower 500 (FIG. 5), i.e., the combination of lower shell 212 and outsole 264, can be completed by joining the separately molded outsole to the lower shell using portions of flange joint 400 (FIGS. 4A-B, 6A) and the outsole in cooperation with one another to join medial and lateral parts 408, 416 together. As illustrated in FIG. 6B, outsole 264 can be provided with a central longitudinal groove 600 that receives flange joint 400, which can be secured to the outsole, for example, by adhesively bonding the flange joint into the groove. Flange joint 400 stabilizes lower shell 212 relative to outsole 264 and provides "vertical" shear surfaces for efficient and strong bonding of the lower shell and outsole into a stable, strong assembly. The flange joint construction also provides the interior sole region 316 (FIGS. 3 and 6A-B) of lower shell 212 with a smooth interior surface having no projections that might cause discomfort to the skier.

Figure 7:
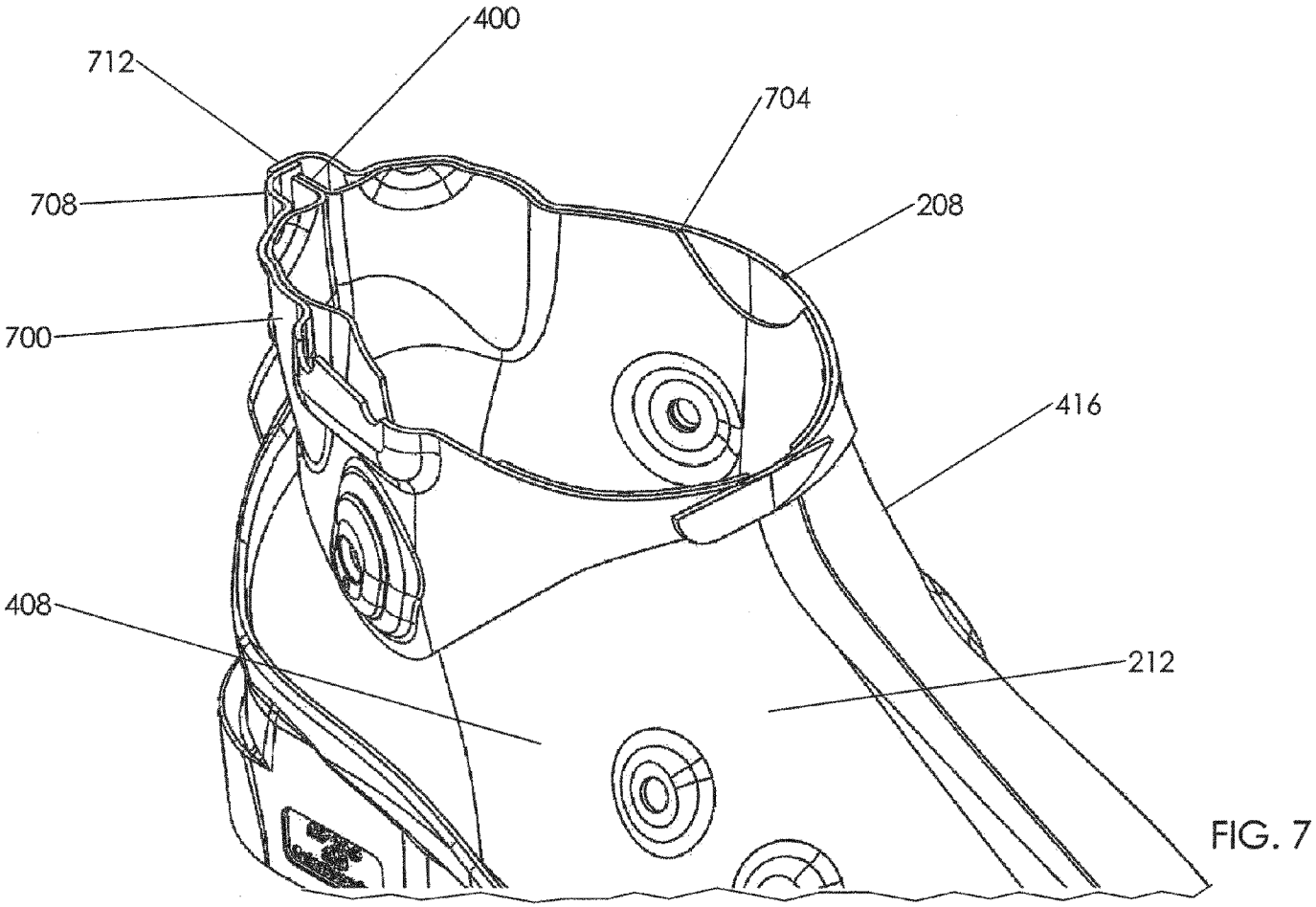
FIG. 7 is a horizontal-cutaway perspective partial view of the ski boot of FIG. 2.

Referring now to FIG. 7, and also to FIGS. 2 and 3, like lower shell 212, upper shell 208 comprises a medial part 700 and a lateral part 704 formed separately from the medial part. Generally, medial and lateral parts 700, 704 are split and joined along a longitudinal (toe/heel) and vertical plane. In this example, medial and lateral parts 700, 704 are joined together at the rear of ski boot 200 by a lap joint 708. Lap joint 708 is part of a flange housing 712 that then cooperates with flange joint 400 that joins together medial and lateral parts 408, 416 of lower shell 212. Flange housing 712 provides enough space around flange joint 400 that upper shell 208 can be aligned at various lateral angles to lower shell 212 to accommodate differing tibial shaft angles of various skiers. In this embodiment, forward lean of ski boot 200 can be fixed or established, for example, using one or more bolts (not shown), or other stop(s), that work in conjunction with rotatable fixing means 228 to create a stable assembly with a fixed forward lean angle. Boss 424 (FIG. 4A) in the lower provides cooperating attachment means on the lower.

Figure 8:
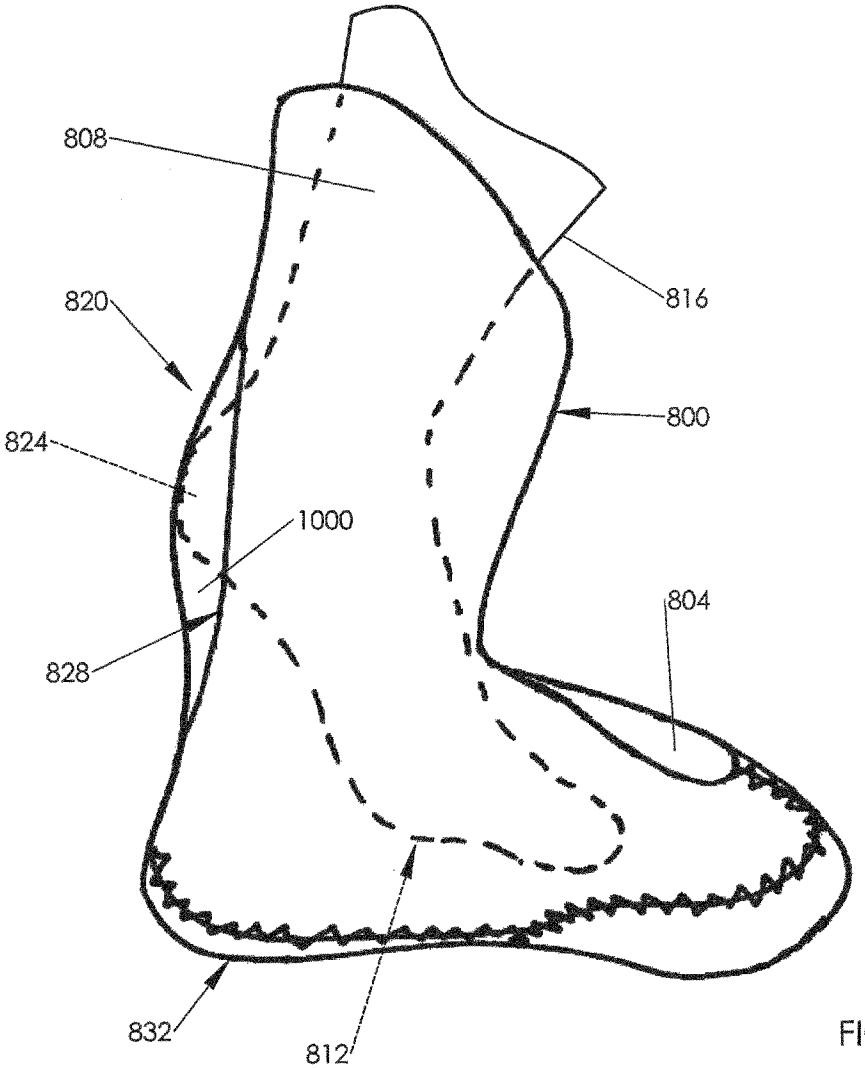
FIG. 8 is a side elevational view of a boot liner that can be used with the sport-boot configuration of FIG. 1 and the ski boot of FIGS. 2-7, showing a foot being inserted into the boot liner.
Figure 9:
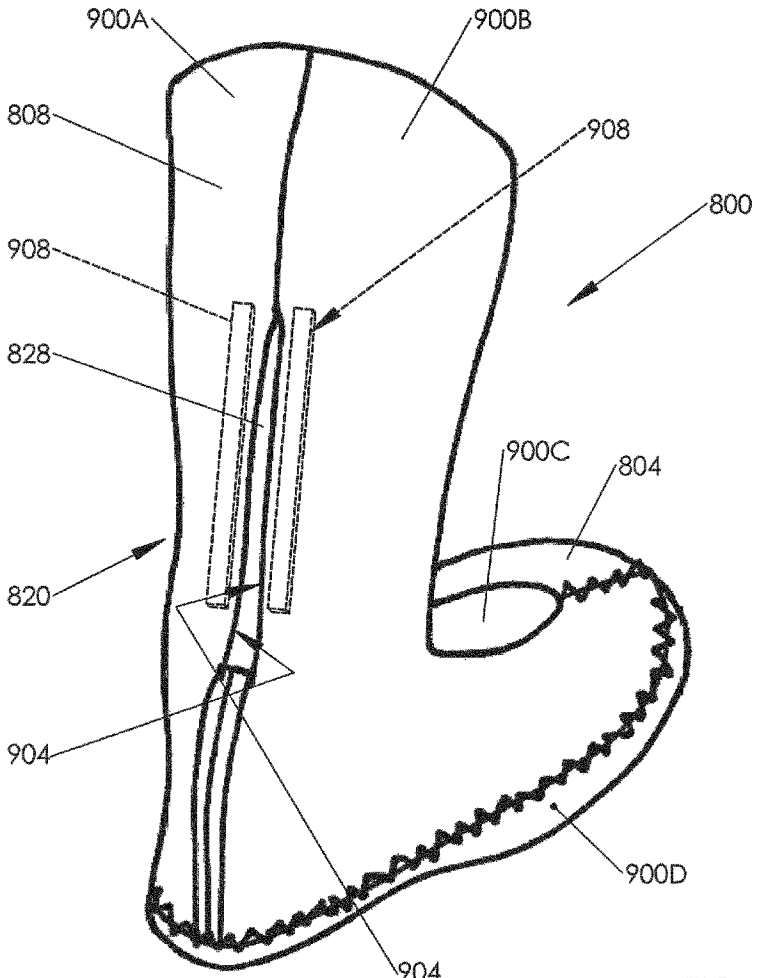
FIG. 9 is a rear perspective view of the boot liner of FIG. 8 showing the expandable dorsal region in a non-expanded, or relaxed, state.
Figure 10:
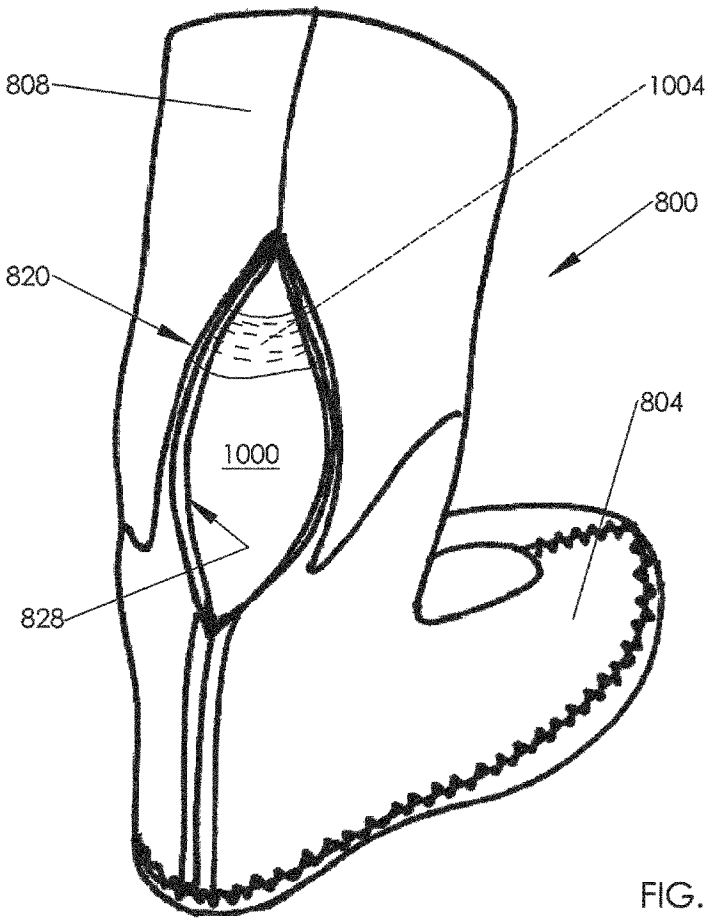
FIG. 10 is a rear perspective view of the boot liner of FIG. 8 showing the expandable dorsal region in an expanded state.

FIGS. 8-10 illustrate a boot liner 800 that can be used with sport-boot configuration 100 of FIG. 1 and, more particularly, ski boot 200 of FIGS. 2-7. Boot liner 800 includes a foot portion 804 and a leg portion 808 that, except for the unique features described below, can be made using any suitable fabrication/construction techniques known for making conventional boot liners, such as foam molding techniques and cobbling/last techniques. In the embodiment shown, boot liner 800 was made using conventional last techniques that involve cutting and shaping various panels/parts 900A-D (FIG. 9) and sewing those panels/parts together. It should be readily understood by those skilled in the art, however, that other embodiments can be made, for example, as unitary moldings, as combinations of moldings and as combinations of moldings and parts cut from sheet material. It is noted that the material(s) used for a boot liner made in accordance with the present disclosure, such as boot liner 800, can be any suitable material(s) that provide(s) the desired cushioning and compressive-conformal fit with a foot 812 and leg 816 when the foot and leg are fully inserted into the boot and any closures on the boot are properly engaged. Examples of such materials include skinned foam rubber and un-skinned foam rubber covered with cloth, among others.

Leg portion 808 includes an expandable dorsal region 820 that, when boot liner 800 is inserted into ski boot 200 (FIG. 2), is in registration with heel track 232 of the ski boot. Expandable dorsal region 820 allows leg portion 808 to expand the full extent heel track 232 (FIG. 2) will allow so as to permit the heel 824 (FIG. 8) of foot 812 to enter the heel track with relatively little resistance from the leg portion of boot liner 800. In this example, expandable dorsal region 820 is facilitated by providing the dorsal region with a discontinuity 828 having lateral edges 904 (FIG. 9) that can readily move apart when heel 824 engages the expandable dorsal region in the manner shown in FIG. 8. In the embodiment shown in FIGS. 8-10, discontinuity 828 is generally provided by not joining panels 900A-B together at lateral edges 904. The term "generally" is used in the preceding sentence to indicate that an additional feature of discontinuity 828 in this embodiment is that the discontinuity also forms an opening 1000 (FIG. 10) when expandable dorsal region 820 is in its unexpanded configuration. In contrast to FIG. 9, FIGS. 8 and 10 each show expandable dorsal region 820 in an expanded configuration in which opening 1000 is enlarged by the action of a user inserting foot 812 into boot liner 800.

In other embodiments wherein at least leg portion 808 is made of a single piece of material, for example, a single molding, the discontinuity at the expandable dorsal region can be, for example, a slit in which the lateral edges touch one another when the expandable dorsal region is in its un-expanded configuration, an elongated opening in which the lateral edges do not touch one another when the expandable dorsal region is in its un-expanded configuration or, depending on the material(s) used for the leg portion, a thinned region of the leg portion in which the lateral edges are defined by the thinning of the material to create the expandable dorsal region. In one example, discontinuity 820 starts at approximately 80 mm above the sole 832 of boot liner 800 at the heel of the liner and ends approximately 230 mm above the sole.

FIGS. 9 and 10 illustrate some additional optional features of boot liner 800 that may be desirable in certain circumstances. As seen in FIG. 9, boot liner 800 may be provided with one or more assistance strips 908 that 1) assist in inhibit vertical buckling of leg portion 808 in expandable dorsal region 820 as the user pushes heel 824 (FIG. 8) downward into the liner or 2) assist in returning expandable dorsal region 820 from an expanded configuration, such as shown in FIG. 10, to its un-expanded configuration, as shown in FIG. 9, after heel 824 is no longer engaged with the expandable dorsal region or 3) assist with both of these tasks. In this example, two assistance strips 908 are located proximate corresponding respective lateral edges 904. Each assistance strip 908 should be designed to provide sufficient resistance to vertical buckling of the material of leg portion 808 in expandable dorsal region 820, but at the same time be sufficiently flexible so as to not dramatically interfere with the expandability of discontinuity 828. As those skilled in the art will readily appreciate, assistance strips 908 can be made of a material, such as a polymer, spring steel, memory metal and any combination thereof, among other materials, that can temporarily deform as needed when heel 824 (FIG. 8) is present in expandable dorsal region 820 but return to its un-deformed shape of the un-expanded configuration of the expandable dorsal region without permanent deformation over a design number of duty cycles anticipated over the life of boot liner 800. Assistance strips 908 may be integrated into the material of boot liner 800, or may be applied to the exterior and/or interior surfaces of the boot liner and/or along confronting surfaces of lateral edges 904.

As seen in FIG. 10, boot liner 800 may also optionally include a stretchable closure 1004 that acts to assisting in the closing of opening 836 when the heel is not present in expandable dorsal region 820. In some embodiments, stretchable closure 1004 covers the entire discontinuity 828/opening 1000, for example, on the interior of leg portion 808 so as to provide a visually "clean" interior to boot liner 800. In this connection, it is noted that only a small portion of stretchable closure 1004 is shown for convenience. The material(s) used for stretchable closure 1004 can be used to cover the entire interior of at least leg portion 808 and, in some embodiments, the interior of foot portion 804, too. For example, the material(s) of stretchable closure 1004 can be secured to the interior regions of leg portion 808 other than discontinuity 828/opening 1000 using any suitable fastening means, such as adhesive, sewing and a combination thereof, among others. In other embodiments, stretchable closure 1004 can include one or more ribbons of stretchable material(s) that traverse discontinuity 828/opening 1000.

Stretchable closure 1004 may be made of any suitable fairly highly stretchable material(s), such as spandex or other fabric having highly elastic fibers integrated therein or fabric-covered elastic band. In some embodiments, it may be desirable to provide stretchable closure 1004 and/or regions of leg portion 808 proximate discontinuity 828 with a low-friction coating to decrease frictional resistance between heel 824 (FIG. 8) (or sock or other material (not shown) covering the heel) and those portions during insertion of foot 812 into boot liner 800 during use.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A sport boot, comprising:

a shell that includes:

a leg portion that has a shin region and a highback leg support region that acts to firmly support a portion of a leg of a person when the person is using the sport boot;

a foot portion for receiving a foot of the person when the person is using the sport boot, said foot portion having an instep region and an instep transition region providing a directional transition between said instep region and said shin region of said leg portion, said foot portion including a toe end, a heel end and a sole portion, said sole portion extending from said toe end to said heel end, said foot portion having a lateral portion and a medial portion and being substantially rigid in a direction parallel to a longitudinal vertical plane that bisects said foot portion into said lateral portion and said medial portion;

a heel pocket formed in said foot portion, said heel pocket designed and configured for inhibiting movement of a heel of the person in a direction away from said sole portion when the person is using the sport boot and when the sport boot is properly fitted to the foot of the person; and a heel track extending between said highback support region and said heel pocket and forming a concave space interior to said shell, wherein said heel track includes an upper end and a lower end spaced from said upper end, said upper end being formed in said leg portion so that said heel track has connective continuity with said highback leg support region and said lower end being formed in said foot portion so that said heel track has connective continuity with said heel pocket, said concave space of said heel track receiving the heel of the person to accommodate the substantial rigidity of said foot portion in the direction parallel to the longitudinal vertical plane when the person is inserting the foot into the sport boot and when the sport boot is properly fitted to the foot of the person, wherein said heel track is formed in a rigid portion of the sport boot so that said heel track has a size, a shape, and a configuration that each remain constant when the person is using the sport boot, when the foot is properly fitted to the sport boot, and when the person is inserting the foot into the sport boot, said rigid portion being substantially fixed in location relative to said instep region.

2. A sport boot according to claim 1, wherein said sole portion has a midpoint midway between said toe end and said heel end and said heel track has a curvature lying in the longitudinal vertical plane, said curvature having a center of curvature located beyond said midpoint of said sole portion in a direction of the toe end of the sole portion.

3. A sport boot according to claim 2, wherein said curvature is substantially circular.

4. A sport boot according to claim 2, wherein said curvature has a radius of less than 400 mm.

5. A sport boot according to claim 4, wherein said curvature has a radius of less than 180 mm.

6. A sport boot according to claim 2, wherein said center of curvature is located above said sole portion.

7. A sport boot according to claim 6, wherein said center of curvature lies in the longitudinal vertical plane and a transverse vertical plane that is located between said midpoint of said sole portion and said toe end.

8. A sport boot according to claim 1, wherein said shell further comprises a reverse-curvature region separating said heel track from said heel pocket.

9. A sport boot according to claim 8, wherein said sole portion has an outside bottom and said heel track has a lower end spaced less than 100 mm from said outside bottom of said sole portion.

10. A sport boot according to claim 9, wherein said heel track has an upper end spaced at least 190 mm from said outside bottom of said sole portion.

11. A sport boot according to claim 1, further comprising an outsole that includes features for securing the sport boot to a ski binding.

12. A sport boot according to claim 11, wherein said outsole includes a toe and heel lugs for engaging corresponding respective toe and heel pieces of an alpine ski binding.

13. A sport boot according to claim 1, wherein said foot portion includes instep flaps that, during insertion of the foot into the sport boot, allow the portion of the foot at said instep region to move parallel to said sole portion away from said heel track no more than about 10 mm.

14. A sport boot according to claim 1, wherein said foot portion includes a lateral part and a medial part joined to said lateral part at least in part by an external flange that is external to said foot portion after said lateral and medial parts have been joined.

15. A sport boot according to claim 14, further comprising a rigid sole piece that includes a longitudinal alignment groove that receives said external flange when the rigid sole piece is secured to said foot portion.

16. A sport boot according to claim 14, wherein said lateral part and said medial part are rigid components comprising a fiber-reinforced material and that form said foot portion of said shell, said external flange being composed of an outwardly turned portion of said lateral part and an outwardly turned portion of said medial part, said outwardly turned portions being joined directly to one another so as to form said external flange.

17. A sport boot according to claim 1, wherein said foot portion is constructed of a fiber-reinforced polymer composite.

18. A sport boot according to claim 1, wherein said shell includes a lower and an upper pivotably attached to said lower, said lower comprising said foot portion and said upper comprising said highback leg support region.

19. A sport boot according to claim 18, wherein, when said lower is completely assembled, said lower includes a central exterior dorsal flange extending parallel to said longitudinal vertical plane and said upper includes a dorsal channel movably receiving said central exterior dorsal flange.

20. A sport boot according to claim 19, wherein said upper has a forward lean angle relative to said lower and said forward lean angle is established by fixing the forward lean angle by mechanical engagement of at least one fixing device with each of the central exterior dorsal flange and said upper.

21. A sport boot according to claim 20, wherein said dorsal channel is defined by a lateral wall, a medial wall and a dorsal wall, and said central exterior dorsal flange has a receiver, said at least one fixing device extending through said lateral and medial walls of said dorsal channel and said receiver of said central exterior dorsal flange.

22. A sport boot according to claim 21, wherein said lower includes a lateral part and a medial part and said central exterior dorsal flange joins said lateral and medial parts of said lower, wherein said central exterior dorsal flange extends away from said lateral and medial part after joining said lateral and medial parts.

23. A sport boot according to claim 22, wherein said upper includes a lateral part and a medial part and said lateral and medial parts of said upper are joined together by a lap joint on said dorsal wall of said dorsal channel.

24. A sport boot according to claim 1, further comprising a flexible boot liner that includes a leg portion containing an expandable dorsal region in registration with said heel track, said expandable dorsal region configured to expand said leg portion to an expanded configuration to allow the heel to readily enter said heel track when the person is inserting the foot into the sport boot and configured to contract from the expanded configuration when the heel is seated in said heel pocket.

25. A sport boot according to claim 24, wherein said expandable dorsal region includes a slit in said flexible boot liner that opens when the person is inserting the heel into the sport boot so as to provide the expanded configuration of said leg portion of said boot liner.

26. A sport boot according to claim 25, wherein said expandable dorsal region further includes an elastic closure for closing said slit when said leg portion is not in the expanded configuration.

27. A sport boot according to claim 25, wherein said expandable dorsal region further includes a flexible reinforcing strip on each lateral side of said slit for inhibiting buckling of said boot liner in said expandable dorsal region during insertion of the foot into said boot liner.

28. A sport boot system, comprising:

a shell that includes:

a leg portion that has a shin region and a highback leg support region that acts to firmly support a portion of a leg of a person when the person is using the sport boot system;

a foot portion for receiving a foot of the person when the person is using the sport boot system, said foot portion having an instep region and an instep transition region providing a directional transition between said instep region and said shin region of said leg portion, said foot portion including a toe end, a heel end and a sole portion, said sole portion extending from said toe end to said heel end, said foot portion having a lateral portion and a medial portion and being substantially rigid in a direction parallel to a longitudinal vertical plane that bisects said foot portion into said lateral portion and said medial portion;

a heel pocket formed in said foot portion, said heel pocket designed and configured for inhibiting movement of a heel of the person in a direction away from said sole portion when the person is using the sport boot system and when the sport boot system is properly fitted to the foot of the person; and a heel track extending between said highback support region and said heel pocket and forming a concave space interior to said shell, wherein said heel track includes an upper end and a lower end spaced from said upper end, said upper end being formed in said leg portion so that said heel track has connective continuity with said highback leg support region and said lower end being formed in said foot portion so that said heel track has connective continuity with said heel pocket, said concave space of said heel track receiving the heel of the person to accommodate the substantial rigidity of said foot portion in the direction parallel to the longitudinal vertical plane when the person is inserting the foot into the sport boot system and when the sport boot system is properly fitted to the foot of the person, wherein said heel track is formed in a rigid portion of the sport boot so that said heel track has a size, a shape, and a configuration that each remain constant when the person is using the sport boot system, when the foot is properly fitted to the sport boot system, and when the person is inserting the foot into the sport boot, said rigid portion being substantially fixed in location relative to said instep region; and a liner made of a compressible material and having a shape that snugly fits the foot and the lower leg and that fits into said shell, said liner including a leg portion containing an expandable dorsal region in registration with said heel track when said liner is present in said shell, said expandable dorsal region configured to expand said leg portion to an expanded configuration to allow the heel of the foot to readily enter said heel track when the person is inserting the foot into the sport boot system and configured to contract from the expanded configuration when the heel is seated in said heel pocket, wherein said expandable dorsal region includes a discontinuity in said leg region that opens when the person is inserting the human foot into the boot shell so as to provide the expanded configuration of said leg portion of the boot liner.

* * * * *